US007849889B2

(12) United States Patent
Smith et al.

(10) Patent No.: US 7,849,889 B2
(45) Date of Patent: Dec. 14, 2010

(54) APPLICATOR WHEEL FOR FILLING CAVITIES WITH METERED AMOUNTS OF PARTICULATE MATERIAL

(75) Inventors: Barry S. Smith, Hopewell, VA (US); Martin T. Garthaffner, Chesterfield, VA (US); Ahmet Ercelebi, Mechanicsville, VA (US); Steven Spiers, Richmond, VA (US); Jeremy Straight, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 873 days.

(21) Appl. No.: 11/805,698

(22) Filed: May 24, 2007

(65) Prior Publication Data

US 2007/0284012 A1 Dec. 13, 2007

Related U.S. Application Data

(60) Provisional application No. 60/809,558, filed on May 31, 2006.

(51) Int. Cl.
*B65B 1/04* (2006.01)

(52) U.S. Cl. ..... 141/125; 141/8; 141/65; 141/67; 141/129; 141/196

(58) Field of Classification Search ..... 141/4–8, 141/65, 67, 125, 129, 144, 196; 222/152, 222/368, 636
See application file for complete search history.

(56) References Cited

U.S. PATENT DOCUMENTS 2,540,059 A * 1/1951 Stirn et al. ..... 141/1
3,312,151 A 4/1967 Molins
3,570,557 A 3/1971 Molins
4,214,508 A * 7/1980 Washington ..... 493/48
4,425,107 A * 1/1984 Hall ..... 493/48
4,509,568 A * 4/1985 Kawaguchi et al. ..... 141/129
5,765,607 A * 6/1998 Ansaloni ..... 141/135
5,875,824 A 3/1999 Atwell et al.
6,267,155 B1 * 7/2001 Parks et al. ..... 141/18
6,723,033 B1 * 4/2004 Scott et al. ..... 493/48
6,805,174 B2 10/2004 Smith et al.
2003/0034085 A1 2/2003 Spiers et al.

* cited by examiner

*Primary Examiner*—Timothy L Maust
(74) *Attorney, Agent, or Firm*—Connolly Bove Lodge & Hutz LLP

(57) ABSTRACT

A machine and process function to fill cavities with metered amounts of particulate material. An applicator wheel includes a series of equally spaced apart peripheral pockets each having a perforated bottom wall, and a vacuum manifold inside the wheel includes a vacuum chamber for supplying vacuum to the perforated bottom walls of the pockets as the wheel rotates. Particulate material from a filling chamber of such material outside the wheel is withdrawn into the pockets by the vacuum chamber. A downstream vacuum relief on the vacuum manifold functions to discharge particulate material from the pockets into the cavities at a predetermined discharge location on the wheel. Adjustment structure is connected to rotatably adjust the position of the vacuum manifold within the applicator wheel to thereby advance or retard the discharge location depending upon the speed of the machine.

13 Claims, 2 Drawing Sheets

28
64
62
52
54
M
24
31
32
20
26
10
34
36
30
24
40
38
42
44
18
50
46
60
14
48
12
16
22B
22A

APPLICATOR WHEEL FOR FILLING CAVITIES WITH METERED AMOUNTS OF PARTICULATE MATERIAL

CROSS REFERENCE TO RELATED APPLICATION

The present application claims the benefit of provisional application Ser. No. 60/809,558, filed May 31, 2006, for all useful purposes, and the specification and drawings thereof are included herein by reference.

BACKGROUND OF THE INVENTION

The present invention generally relates to methods and apparatus for accurately delivering precisely metered amounts of particulate material from an applicator wheel in a repetitive manner during high speed manufacture of particulate-filled articles of manufacture, and more particularly to precise and repetitive delivery of particulate material from an applicator wheel into spaces presented during the manufacture of plug-space-plug cigarette filters.

Certain articles of manufacture such as carbon cigarette filters, individual-sized packets of granular food products or condiments, capsuled pharmaceuticals, ammunition and the like require repetitive placement of precisely metered charges of particulate matter at some location along the production-line procession of the articles. During high speed mass production of such articles it is difficult to achieve consistent accurate filling of the desired cavities with the granular particles. In the case of filling cigarette filter cavities with carbon or other particulate filter materials, it is desirable to avoid excessive pulverization and scattering of the particulate material, while achieving as close to 100% fill of the cavities as possible.

U.S. Pat. No. 5,875,824, which is incorporated by reference herein in its entirety, discloses a method and apparatus for delivering predetermined amounts of material, wherein a single metering wheel receives discrete amounts of material from a supply chute, with the discrete amounts of material being transferred from the metering wheel to a transfer wheel, and from the transfer wheel into spaces along a filter rod. As a result of the transfer of particles from one wheel to another, the pockets for receiving the particulate material in the transfer wheel must be larger than the pockets in the metering wheel. This arrangement makes it difficult to achieve 100% fill of the cavities in the article receiving particulate material from the transfer wheel.

According to the '824 patent, granular particles of carbon are drawn from a chute in communication with a reservoir into pockets on a rotating metering wheel. The rim of the metering wheel includes a plurality of equally spaced-apart pockets, each of which is defined by a radially directed, conical bore and a discrete screen at the base of the conical bore. The conical bore is convergent in the radially inward direction. A radially directed channel within the rim of the metering wheel communicates a backside of the screen with the interior of the metering wheel. A vacuum can be communicated from a stationary vacuum plenum in the interior of the metering wheel through the radial channel and screen such that any granular particles of the carbon that are adjacent the pocket in the metering wheel will be drawn into the conical bore of the pocket until it is filled.

U.S. Pat. No. 6,805,174, which is incorporated by reference herein in its entirety, also discloses a method and apparatus for filing spaced apart cavities with particulate material. The cavities are partially filled with particulate material at an upstream location while applying vacuum underneath each cavity during such partial filing. The partially filled cavities are then completely filled with a downstream deposit of particulate material while supplying vacuum to the upper sides of each cavity during such filling. The combination of vacuum applied underneath the cavity during partial fill and vacuum applied to the top sides of the cavity during complete fill produces approximately 100% cavity fill with minimal extraneous scatter of particulate material. At each upstream and downstream filling locations pockets of particulate material on the outside of a vacuum drum are relieved of vacuum to thereby transfer the particulate material from the pockets on the vacuum drum to the cavities.

SUMMARY OF THE INVENTION

Accordingly, one of the objects of the present invention is a machine including a applicator wheel that fills cavities with metered amounts of particulate material in an efficient and timely manner.

Another object of the present invention is a machine capable of operating at different speeds, but which discharges metered amounts of particulate material without scatter regardless of which speed the machine is operating.

Still another object of the present invention is a process for delivering metered amounts of particulate material to a series of cavities while achieving total fill of the cavities without scatter of the particulate material.

In accordance with the present invention, a machine comprises an applicator wheel for filling cavities with metered amounts of particulate material. A series of equally spaced apart peripheral pockets are positioned on the wheel, and each pocket has a perforated bottom wall. A vacuum manifold inside the wheel includes a vacuum chamber for supplying vacuum to the perforated bottom wall of each pocket as the wheel rotates. A filling chamber of particulate material is positioned outside the wheel and this material is withdrawn into the pockets by the vacuum chamber. Downstream from the vacuum chamber the manifold includes a vacuum relief for discharging particulate material from the pockets into the cavities at a predetermined discharge location on the wheel. Adjustment structure is connected to rotatably adjust the position of the vacuum manifold within the applicator wheel to advance or retard the discharge location depending upon the speed of the machine to thereby achieve desired fill of the cavities without significant scatter of the particulate material.

Preferably the vacuum manifold has a pressured air port to assist in discharge of the particulate material from the pockets when vacuum relief occurs.

In one embodiment of the present invention the adjustment structure simultaneously adjusts the positions of the vacuum chamber, vacuum relief and pressurized air port, and in another embodiment of the present invention the adjustment structure adjusts the position of the vacuum chamber while independently adjusting the vacuum relief and pressured air port. In the later embodiment, the vacuum manifold may include an adjustable segment therein, and the vacuum relief and pressurized air port may be positioned in the adjustable segment. Moreover, in the later embodiment one operator adjusts the position of the vacuum manifold while a second operator moves the adjustable segment within the vacuum manifold.

Preferably, the flow amount of particulate material to the filling chamber is variable with increased flow amounts at higher machine speeds and lower amounts at lower machine speeds.

The present invention also includes a process for filling cavities with metered amounts of particulate material that includes the step of rotating an applicator wheel having a plurality of equally spaced apart peripheral pockets, each with a perforated bottom wall, past a filling chamber of particulate material. Further steps include supplying vacuum from inside the wheel to the perforated bottom walls to draw particulate material into the pockets from the filling chamber, and relieving vacuum on the pockets at a predetermined discharge location on the applicator wheel to thereby discharge the particulate material from the pockets to the cavities. The discharge location may be advanced or retarded depending on the machine speed.

Other steps in the process may include directing air under pressure to the pockets from within the applicator wheel to assist in discharge of the particulate material therein when the vacuum is relieved. Also, the positions of the vacuum supply, the vacuum relief and the air under pressure may be simultaneously adjusted depending upon the machine speed. Alternatively, the position of supply of vacuum may be adjusted while the positions of vacuum relief and air under pressure may be independently adjusted.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

The present invention provides a system useful for transferring accurately metered volumes of particles to cavities in an article or articles being produced at a high rate during mass production of the articles. The system includes at least one applicator wheel which rotates around a central adjustable vacuum manifold including at least one vacuum chamber. A series of pockets are defined along an outer circumferential surface of the applicator wheel between the outer periphery of the wheel and a perforated band or screen that is clamped against the inner periphery of the wheel, to both accurately meter and transfer predetermined amounts of granules or particles into cavities of one or more articles.

The drawings illustrate an assembly line for producing cigarette filter rods of spaced apart cellulose acetate plugs with cavities therebetween filled with particulate material and surrounded by plug wrap. Initially the paper wrapped around the filter rod is left open at the top side of the filter rod as the filter rod passes by at least one filling station. Particles or granules of carbon are inserted into the spaced cavities along the filter rod through the openings on the top side of the filter rod as the rod passes under the filling station. After the rod leaves the filling station and continues to travel downstream, the paper plug wrap that has been left open at the top of the filter rod is folded over the filter components and particle filled cavities and glued and sealed to complete the filter rod construction.

Figure 1:
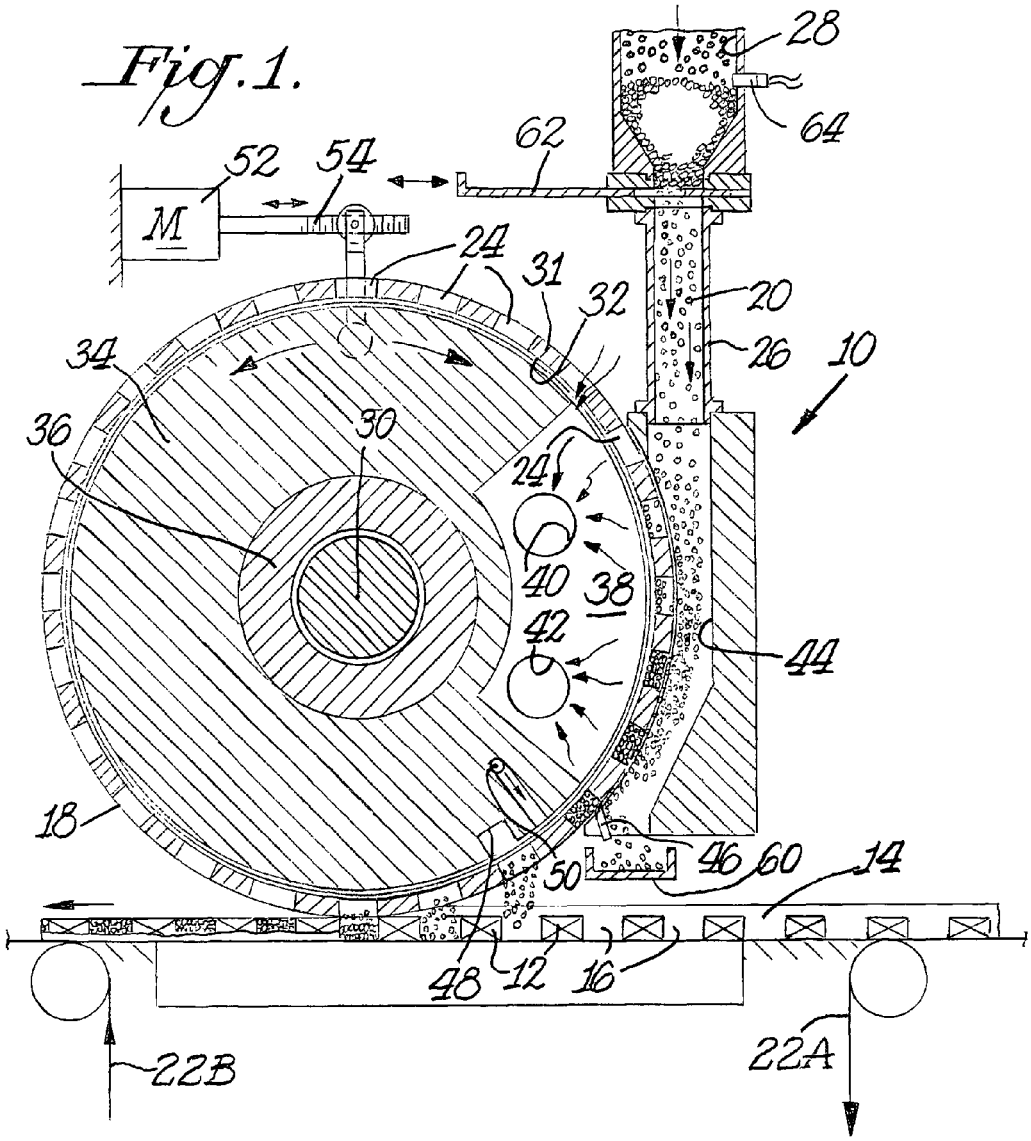
FIG. 1 is a diagrammatic side elevational view of a high speed applicator wheel with an adjustable vacuum manifold for filling cavities with metered amounts of particulate material, in accordance with the present invention.

Referring in more particularity to the drawings, FIG. 1 illustrates a diagrammatic side elevational view of high speed machinery 10 that includes at least one applicator wheel for filling cavities with metered amounts of particulate material in the manufacture of cigarette filter rods. Fundamentally, at the entrance to machinery 10 spaced apart plugs 12 of cellulose acetate are secured to plug wrap paper 14 by glue deposited onto paper 14 at a glue applicator (not shown). The paper 14 is partially wrapped around the spaced apart plugs 12 but left open at the top side to thereby form spaces or cavities 16 between adjacent plugs traveling along a longitudinal path through the machinery 10. At least one applicator wheel 18 functions to supply discrete portions of particulate material such as carbon 20 into the cavities 16, as explained more fully below. After the cavities are filled with the particulate material, the paper 14 is folded and glued in place around the cellulose acetate plugs and the filled cavities therebetween by a vacuum garniture 21 (partially shown). An upstream belt 22A functions to push the plug wrap 14 with the spaced apart cellulose acetate plugs 12 secured thereto along a longitudinal path of travel past the machinery 10 while a downstream belt 22B operates to pull the plug wrap through the machinery 10.

The applicator wheel 18 includes pockets 24 that receive carbon material 20 from a carbon chute 26. The carbon chute is supplied with carbon from a hopper 28. Vacuum is applied to the inner bottom surface of each pocket on the applicator wheel as the pockets travel past the carbon chute 26, and the carbon is thereby drawn into each of the pockets 24. Ultimately, when the pockets 24 filled with carbon 20 reach a predetermined point relative to the cavities 16, pressure is applied and the vacuum is released to urge the carbon out of the pockets into the cavities.

The applicator wheel 18 includes a wheel drive shaft 30 for rotating the applicator wheel, particularly the pockets 24 on the periphery of the wheel. The pockets are positioned between spacer elements 31 arranged around the periphery of the wheel, and the bottom of each pocket includes a perforated screen 32 open to the interior of the applicator wheel and a moveable interior vacuum manifold 34. A bearing housing 36 is positioned between the wheel drive shaft 30 and vacuum manifold 34. This arrangement allows the vacuum manifold to rotate slightly for adjustment purposes, as explained more fully below.

A vacuum chamber 38 is located within the vacuum manifold 34, and vacuum from supply ports 40, 42 in the vacuum chamber supply vacuum to the perforated screen 32 within each pockets 24 as the applicator wheel rotates past a filling chamber 44 adjacent the applicator wheel. The filling chamber is supplied with carbon particles 20 from the hopper 28 and it is associated carbon chute 26.

As the pockets 24 rotate past the filling chamber 44, the pockets are filled with carbon particles by the vacuum within the chamber 38 acting upon the perforated screens 32. As the filled pockets exit the filling chamber 44 a scrapper bar 46 removes any excess carbon from the pockets 24. Ultimately with vacuum still being applied to the perforated screens, the filled pockets reach a vacuum relief groove 48 in the vacuum manifold 34 where the vacuum is relived and pressurized air from port 50 is applied to the screens. This action causes the carbon particles 20 within the pockets to transfer therefrom into the cavities 16 between the filter plugs 12. The vacuum relief groove may be longer than illustrated, if desired.

By way of example, the carbon particles within the pockets 24 of the applicator wheel 18 are discharged at a 5:30 position (when viewed from FIG. 1) which is ideal for a machine speed of 1500 filters per minute. However, when the machinery 10 is run at speeds other than 1500 filters per minute, the 5:30 discharge position is not optimum and can easily result in scatter of the carbon particles 20 on the continuous filter rod and/or variable cavity fill. These disadvantages are addressed in the present invention in that the vacuum manifold 34 is rotatable in a clockwise or counter clockwise direction which changes the point of discharge of the carbon particles from their respective pockets 24 on the periphery of the applicator wheel 18.

When the machinery 10 is operated at a machine speed greater than 1500 filters per minute it is essential that the discharge of particles from the pockets occurs further upstream or earlier than when the discharge occurs at the 5:30 position. Earlier release eliminates granular scatter and provides desirable cavity fill. In order to achieve such earlier release of the particles from the pockets, the vacuum manifold 34 is rotated in a counter clockwise direction by a motor 52 and operator mechanism 54 connected to the vacuum manifold to thereby advance the manifold. Such movement of the vacuum manifold then positions the vacuum relief groove upstream from the 5:30 position to thereby achieve optimum discharge of the carbon particles. Otherwise the machinery operates in the same manner a described above.

Conversely, when the speed of the machinery 10 is run at speeds lower than 1500 filters per minute, the vacuum manifold is slightly rotated in a clockwise direction to thereby retard the discharge point further downstream from the 5:30 position of the above example.

Figure 2:
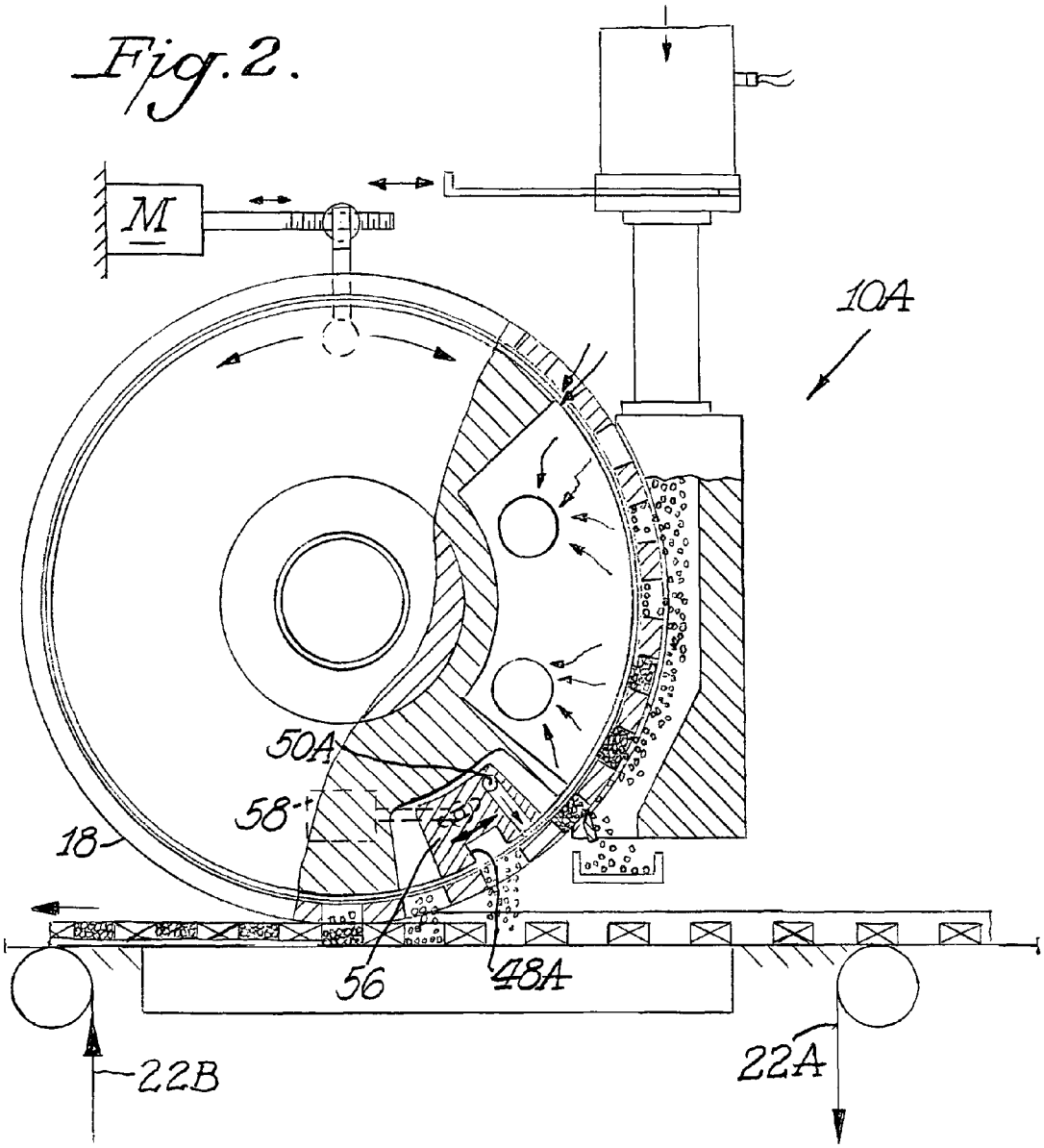
FIG. 2 is a diagrammatic side elevational view illustrating an alternate embodiment of another high speed applicator wheel, according to the present invention.

It should be noted that advancing or retarding the vacuum manifold 34 simultaneously changes the vacuum relief groove 48, air port 50 and the vacuum chamber 38. Since this combined movement may not always be desirable, FIG. 2 illustrates an alternate machine 10A where the pressurized air port 50A and vacuum relief groove 48A are built into a separate adjustable segment 56. Segment 56 is adjustable within the vacuum manifold 34 by a suitable operator 58. Machinery 10A operates in the same manner as machinery 10 except that the vacuum relief groove 48 and air port 50 are adjustable relative to the vacuum chamber 38. This option allows the motor 52 and operator mechanism 54 to control the position of the vacuum chamber 38 and the other operator 58 to control the final position of the vacuum relief groove 48A and air discharge port 50A. Also, the vacuum relief groove may be longer than illustrated, if desired.

The volume of granular material 20 in the filling chamber 44 may affect the filling of pockets 34 in the applicator wheel 18 as the machinery 10 changes speed. Accordingly, it is desirable to vary the granular feed from the hopper 28 to the filling chamber 44 via the supply chute 26 to thereby ensure consistent filling of the pockets 24 and minimum granular over feed to a return tray 60 positioned to receive the granules removed by the scraper bar 46. In this regard, a slide valve 62 may be positioned between the hopper 28 and the chute 26, and an operator (not shown) may be connected to open and close the slide valve 62 depending upon machine speed and other parameters. Since the granular flow through the slide valve 62 is dependent to some extent on the amount of material in the hopper 28, a sensor 64 or a series of such sensors may be placed in the hopper for monitoring the granular level and increasing or decreasing granular feed to the hopper to maintain a certain level of granular material.

All actuator movements may be controlled by a PLC or similar device to ensure optimum running at all machine speeds.

The pressurized air port 50, 50A may be located at a position prior to or together with the vacuum relief groove, and the final configuration is dictated by the speed of the wheel, the density of the media 20 and the vacuum level required to fill and hold the media in the pockets.

One skilled in the art will appreciate that the present invention may be practiced by embodiments other than the above-described embodiments, which have been presented for purposes of illustration and not of limitation. The device and methodologies embodied in the above-described embodiments are adaptable to delivering various types of particulate or granular material and could be used in applications other than the filling of portions of cigarette filters. For example, the device is readily adaptable to the filling of pharmaceutical doses, or the repetitive displacement of powdered food stuffs or other powdered, granular or particulate products into discrete packaging or containers.

Also, plural applicator wheels 18 may be utilized in the filling operation together with a suitable garniture, as shown for example in U.S. Pat. No. 6,805,174.

What is claimed is:

1. A machine comprising an applicator wheel for filling cavities with metered amounts of particulate material, a motivator for rotating the wheel, a series of equally spaced apart peripheral pockets on the wheel each having a perforated bottom wall, a vacuum manifold inside the wheel including a vacuum chamber for supplying vacuum to the perforated bottom walls of the pockets as the wheel rotates, a filling chamber of particulate material outside the wheel from which particulate material is withdrawn into the pockets by the vacuum chamber, a vacuum relief on the vacuum manifold for discharging particulate material from the pockets into the cavities at a predetermined discharge location on the wheel, and adjustment structure connected to rotatably adjust the position of the vacuum manifold within the applicator wheel to advance or retard the discharge location depending upon the speed of the machine.

2. A machine as in claim 1 including a pressurized air port on the vacuum manifold to assist in discharging particulate material from the pockets when vacuum relief occurs.

3. A machine as in claim 2 wherein the pressurized air port is located at a position prior to or together with the vacuum relief.

4. A machine as in claim 2 wherein the adjustment structure simultaneously adjusts the positions of the vacuum chamber, vacuum relief and pressurized air port.

5. A machine as in claim 2 wherein the adjustment structure adjusts the position of the vacuum chamber and independently adjusts the positions of the vacuum relief and pressurized air port.

6. A machine as in claim 5 wherein the vacuum manifold includes an adjustable segment and the vacuum relief and pressurized air port are positioned in the adjustable segment.

7. A machine as in claim 6 including an operator for adjusting the vacuum manifold and a separate operator for moving the adjustable segment within the vacuum manifold.

8. A machine as in claim 1 including a hopper of particulate material for supplying the filling chamber, and a valve on the hopper for controlling the flow amount of particulate material from the hopper to the filling chamber.

9. A machine as in claim 8 including an operator connected to the valve on the hopper, the operator functioning to further open the valve at higher machine speeds and close the valve somewhat at lower machine speeds.

10. A process of filling cavities with metered amounts of particulate material comprising the steps of:

rotating an applicator wheel having a plurality of equally spaced apart peripheral pockets, each with a perforated bottom wall, past a filling chamber of particulate material;

supplying vacuum from inside the wheel to the perforated bottom walls of the pockets to draw particulate material into the pockets from the filling chamber;

relieving vacuum on the pockets at a predetermined discharge location on the applicator wheel to thereby discharge the particulate material from the pockets to the cavities; and advancing or retarding the predetermined discharge location depending upon machine speed.

11. A process as in claim 10 including the step of directing air under pressure to the pockets from within the applicator wheel to assist in discharging the particulate material.

12. A process as in claim 11 including the step of simultaneously adjusting the positions of the supply of vacuum, the vacuum relief and the air under pressure depending upon machine speed.

13. A process as in claim 11 including the steps of adjusting the position of supply of the vacuum and independently adjusting the positions of the vacuum relief and the air under pressure.

* * * * *